US009300034B2

(12) United States Patent
Chen et al.

(10) Patent No.: US 9,300,034 B2
(45) Date of Patent: Mar. 29, 2016

(54) MULTI-ANTENNA STRUCTURE

(71) Applicant: Auden Techno.Corp., Taoyuan Hsien (TW)

(72) Inventors: Chun-Hua Chen, Taoyuan Hsien (TW); Hsien-Wen Liu, Taoyuan Hsien (TW)

(73) Assignee: AUDEN TECHNO. CORP., Pa-Te, Taoyuan Hsien (TW)

( * ) Notice: Subject to any disclaimer, the term of this patent is extended or adjusted under 35 U.S.C. 154(b) by 327 days.

(21) Appl. No.: 13/936,035

(22) Filed: Jul. 5, 2013

(65) Prior Publication Data

US 2015/0009092 A1 Jan. 8, 2015

(51) Int. Cl.

| | |
|---|---|
| ***H01Q 1/24*** | (2006.01) |
| ***H01Q 1/52*** | (2006.01) |
| ***H01Q 9/42*** | (2006.01) |
| ***H01Q 5/371*** | (2015.01) |

(52) U.S. Cl.

CPC ..... *H01Q 1/243* (2013.01); *H01Q 1/521* (2013.01); *H01Q 5/371* (2015.01); *H01Q 9/42* (2013.01)

(58) Field of Classification Search

USPC ..... 343/893, 700 MS, 702

See application file for complete search history.

(56) References Cited

U.S. PATENT DOCUMENTS

2015/0009092 A1* 1/2015 Chen ..... H01Q 1/243 343/893

* cited by examiner

*Primary Examiner* — Hoang V Nguyen
*Assistant Examiner* — Hai Tran
(74) *Attorney, Agent, or Firm* — Muncy, Geissler, Olds & Lowe, P.C.

(57) ABSTRACT

A multi-antenna structure includes a base plate, a first antenna, a second antenna, a first metal line, and a second metal line. The base plate includes a grounded metal surface. The grounded metal surface includes two short sides and two long sides. The first antenna and the second antenna are arranged on the base plate. The first metal line and the second metal line are electrically connected to the two short sides of the grounded metal surface. A current path of the two short sides is prolonged because of the first metal line and the second metal line. A longitudinal current is equal to a transverse current at a low frequency. A current of the first antenna and a current of the second antenna does not interfere each other. Isolation between the first antenna and the second antenna is improved.

5 Claims, 5 Drawing Sheets

MULTI-ANTENNA STRUCTURE

BACKGROUND OF THE INVENTION

1. Field of the Invention

The present invention relates to an antenna, and especially relates to a multi-antenna structure with multi-input multi-output (MIMO).

2. Description of the Related Art

The technology is progressing every day. It is a technology trend that two LTE (long term evolution)/WWAN MIMO antennas are arranged in a mobile device in order to improve communication quality and speed. However, the low frequency isolation and correlation of the two antennas are usually not good. This is because the radiation field of the low frequency is almost omnidirectional. Therefore, the transmission rate cannot be improved greatly.

FIG. 1 shows a diagram of a conventional two-antenna structure. A conventional two-antenna structure includes a base plate 10, a first antenna 20, and a second antenna 30. A grounded metal surface 101 is arranged on the base plate 10. The grounded metal surface 101 includes two short sides 102 and two long sides 103. The first antenna 20 is arranged on one of the short sides 102. The second antenna 30 is arranged on the other short side 102. The longitudinal current is larger than the transverse current at low frequency because the current path of the two short sides 102 is shorter than the current path of the two long sides 103. Therefore, the current of the first antenna 20 and the current of the second antenna 30 interferes each other easily. The low frequency isolation is bad.

FIG. 2 shows a curve diagram for the isolation analysis of the conventional two-antenna structure. A second curve 50 includes a high frequency isolation 501 and a low frequency isolation 502. The longitudinal current is larger than the transverse current at low frequency because the current path of the two short sides 102 is shorter than the current path of the two long sides 103. The low frequency isolation between the two antennas (−6 dB at the low frequency isolation 502) is bad. Therefore, the current of the first antenna 20 and the current of the second antenna 30 interferes each other easily. The transmission rate cannot be improved greatly.

SUMMARY OF THE INVENTION

In order to solve the above-mentioned problems, an object of the present invention is to provide a multi-antenna structure. Two metal lines are arranged on the two short sides of the grounded metal surface of the base plate. Therefore, the current path of the two short sides is equal to the current path of the two long sides. The longitudinal current is equal to the transverse current. The isolation between the two antennas is good. The current of the first antenna and the current of the second antenna does not interfere each other easily. The transmission rate can be improved greatly.

In order to achieve the object of the present invention mentioned above, the multi-antenna structure includes a base plate, a first antenna, a second antenna, a first metal line, and a second metal line. The base plate includes a grounded metal surface. The grounded metal surface includes two short sides and two long sides. The first antenna is arranged on the base plate and is arranged on one of the short sides. The second antenna is arranged on the base plate and is arranged on the other short side. The first metal line is electrically connected to one of the short sides. The second metal line is electrically connected to the other short side. Moreover, a current path of the two short sides is prolonged because of the first metal line and the second metal line. A longitudinal current is equal to a transverse current at a low frequency. A current of the first antenna and a current of the second antenna does not interfere each other. Isolation between the first antenna and the second antenna is good.

Moreover, the base plate is a printed circuit board. The base plate includes a first signal feed line and a second signal feed line. The two short sides of the base plate are an upper short side and a lower short side. The two long sides of the base plate are a right long side and a left long side.

Moreover, the first antenna includes a first rack. The first rack includes a first radiator having a plurality of metal lines. The first radiator is electrically connected to the first signal feed line. The first signal feed line is electrically connected to a coaxial cable.

Moreover, the second antenna includes a second rack. The second rack includes a second radiator having a plurality of metal lines. The second radiator is electrically connected to the second signal feed line. The second signal feed line is electrically connected to a coaxial cable.

Moreover, the first metal line is electrically connected to the upper short side of the grounded metal surface and is reeled on the first rack of the first antenna or is pasted on a casing of an electronic device.

Moreover, a length of the first metal line pluses a length of the upper short side of the grounded metal surface is between half and one-eighth wavelength of a center frequency of the low frequency.

Moreover, it is the best if the length of the first metal line pluses the length of the upper short side of the grounded metal surface is quarter wavelength of the center frequency of the low frequency.

Moreover, the second metal line is electrically connected to the lower short side of the grounded metal surface and is reeled on the second rack of the second antenna or is pasted on the casing of the electronic device.

Moreover, a length of the second metal line pluses a length of the lower short side of the grounded metal surface is between half and one-eighth wavelength of the center frequency of the low frequency.

Moreover, it is the best if the length of the second metal line pluses the length of the lower short side of the grounded metal surface is quarter wavelength of the center frequency of the low frequency.

DETAILED DESCRIPTION OF THE INVENTION

Figure 1:
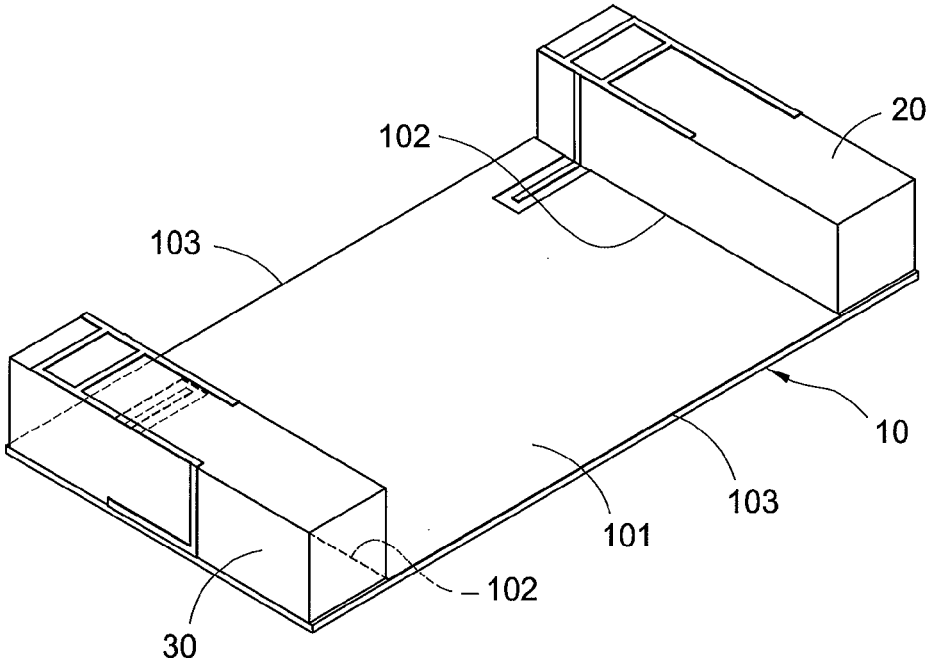
FIG.1 (Related Art)
FIG. 1 shows a diagram of a conventional two-antenna structure.
Figure 2:
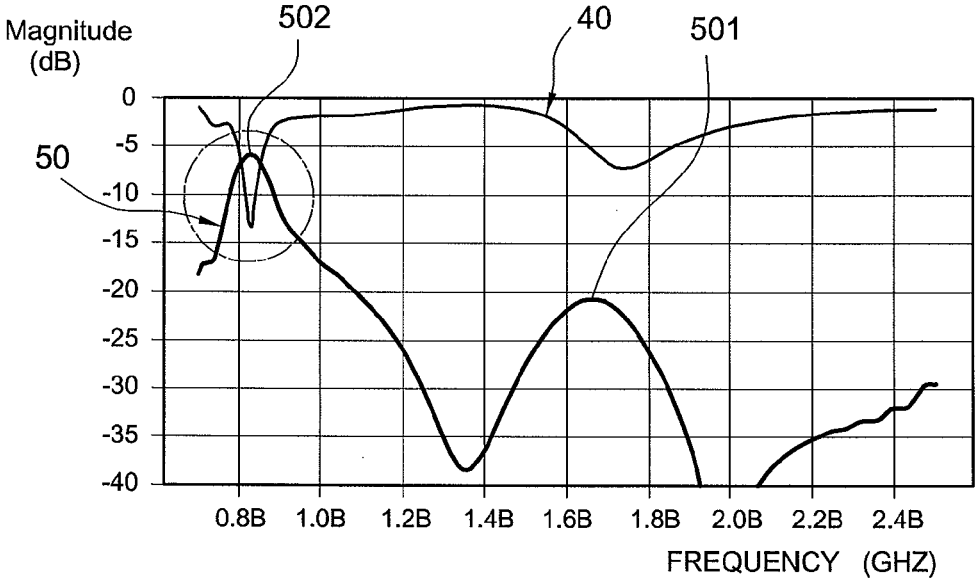
FIG.2 (Related Art)
FIG. 2 shows a curve diagram for the isolation analysis of the conventional two-antenna structure.
Figure 3:
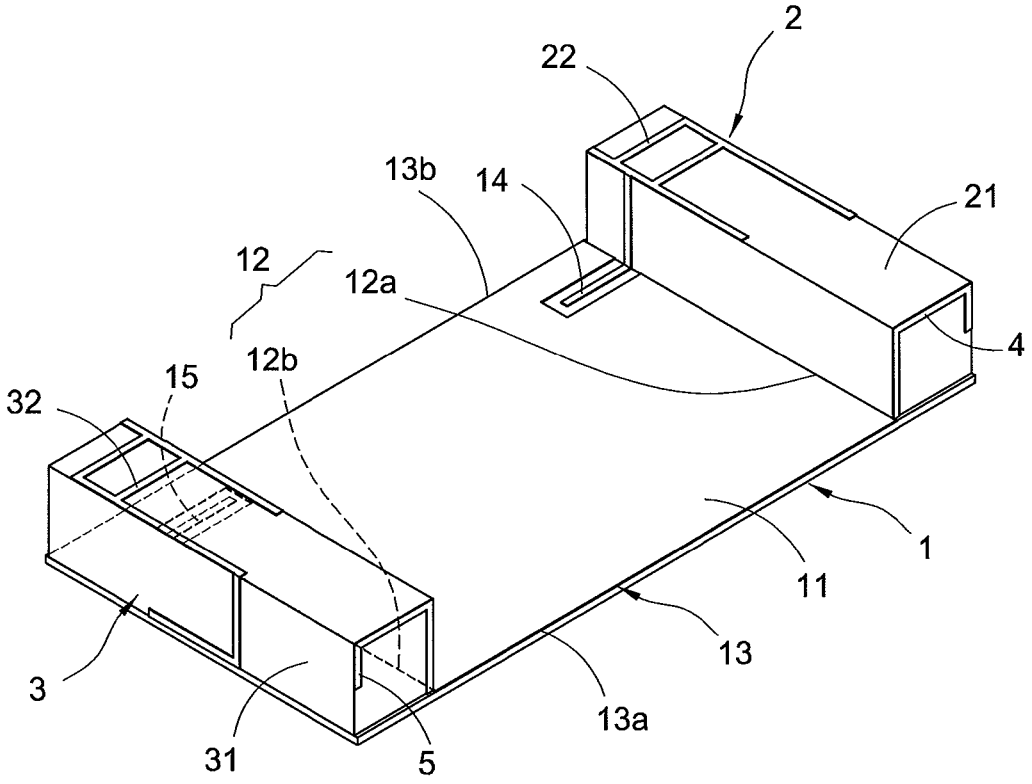
FIG. 3 shows a diagram of a two-antenna structure of the present invention.
Figure 4:
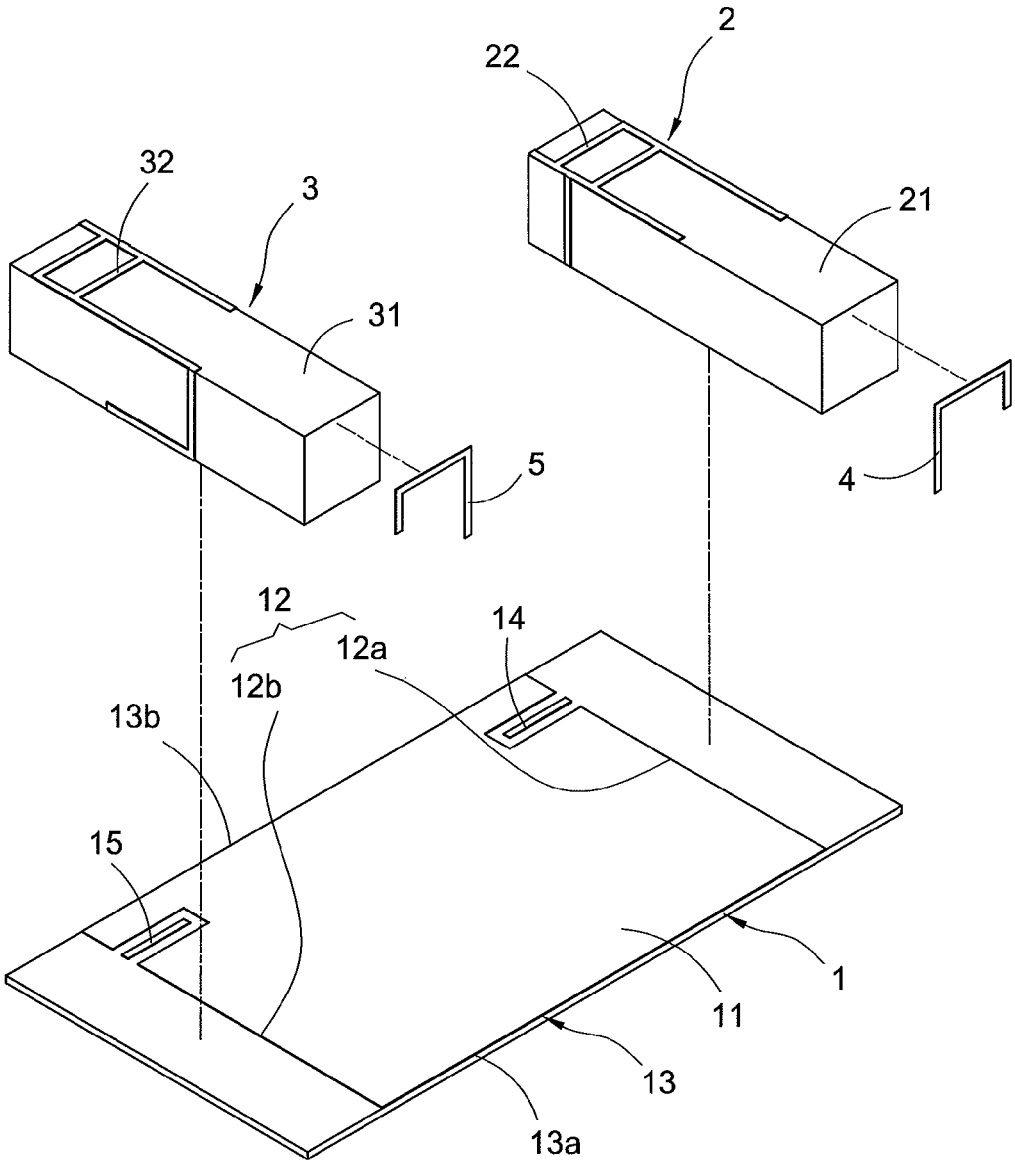
FIG. 4 shows an exploded view of the two-antenna structure of the present invention.

FIG. 3 shows a diagram of a two-antenna structure of the present invention. FIG. 4 shows an exploded view of the two-antenna structure of the present invention. The multi-antenna structure includes a base plate 1, a first antenna 2, a second antenna 3, a first metal line 4, and a second metal line 5.

The base plate 1 includes a grounded metal surface 11. The grounded metal surface 11 includes a two-short-side 12 and a two-long-side 13. The two-short-side 12 includes an upper short side 12*a* and a lower short side 12*b*. The two-long-side includes a right long side 13*a* and a left long side 13*b*. The base plate 1 includes a first signal feed line 14 and a second signal feed line 15. The base plate 1 is a printed circuit board.

The first antenna 2 is arranged on the base plate 1. The first antenna 2 includes a first rack (first carrier) 21 arranged on the upper short side 12*a*. The first rack 21 includes a first radiator 22 having a plurality of metal lines. The first radiator 22 is electrically connected to the first signal feed line 14. The first signal feed line 14 is electrically connected to a coaxial cable (not shown in FIG. 3 and FIG. 4).

The second antenna 3 is arranged on the base plate 1. The second antenna 3 includes a second rack (second carrier) 31 arranged on the lower short side 12*b*. The second rack 31 includes a second radiator 32 having a plurality of metal lines. The second radiator 32 is electrically connected to the second signal feed line 15. The second signal feed line 15 is electrically connected to a coaxial cable (not shown in FIG. 3 and FIG. 4).

The first metal line 4 is electrically connected to the upper short side 12*a* of the grounded metal surface 11 and is reeled on the first rack 21 of the first antenna 2. A length of the first metal line 4 pluses a length of the upper short side 12*a* of the grounded metal surface 11 is between half and one-eighth wavelength (most preferably in quarter wavelength) of a center frequency of the low frequency.

The second metal line 5 is electrically connected to the lower short side 12*b* of the grounded metal surface 11 and is reeled on the second rack 31 of the second antenna 3. A length of the second metal line 5 pluses a length of the lower short side 12*b* of the grounded metal surface 11 is between half and one-eighth wavelength (most preferably in quarter wavelength) of the center frequency of the low frequency.

Therefore, a current path of the upper short side 12*a* and the lower short side 12*b* is prolonged because of the first metal line 4 and the second metal line 5. A length and strength of the current path of the upper short side 12*a* and the lower short side 12*b* is equal to a length of the current path of the right long side 13*a* and the left long side 13*b*. The interference between the two antennas is reduced. The isolation for the low frequency of the two antennas is improved.

Figure 5:
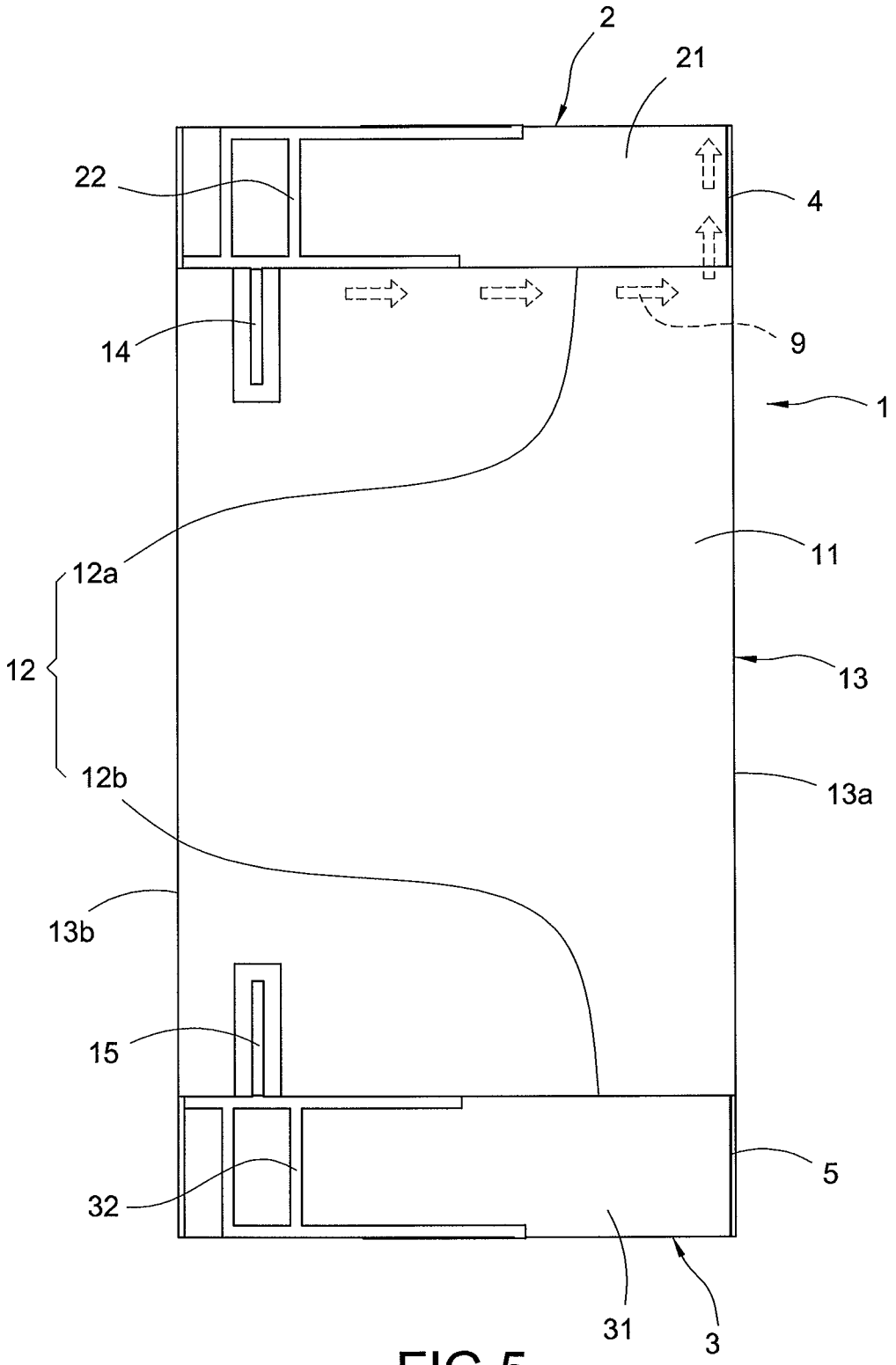
FIG. 5 shows a current path of the two-antenna structure of the present invention.

FIG. 5 shows a current path of the two-antenna structure of the present invention. The upper short side 12*a* is electrically connected to the first metal line 4. The lower short side 12*b* is electrically connected to the second metal line 5. Therefore, a current path 9 of the upper short side 12*a* and the lower short side 12*b* is prolonged. The length of the current path of the upper short side 12*a* and the lower short side 12*b* is equal to the length of the current path of the right long side 13*a* and the left long side 13*b*. The longitudinal current is equal to the transverse current in low frequency. The interference between the first antenna 2 and the second antenna 3 is reduced. The isolation for the low frequency of the first antenna 2 and the second antenna 3 is good.

Figure 6:
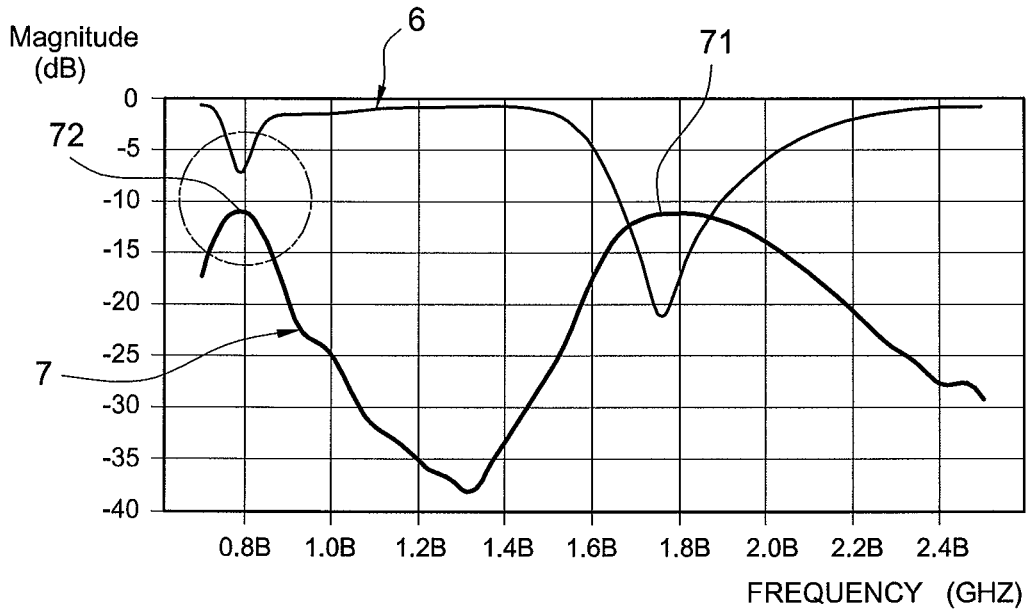
FIG. 6 shows a curve diagram for the isolation analysis of the two-antenna structure of the present invention.

FIG. 6 shows a curve diagram for the isolation analysis of the two-antenna structure of the present invention. A second curve 7 includes a high frequency isolation 71 and a low frequency isolation 72.

The upper short side 12*a* is electrically connected to the first metal line 4. The lower short side 12*b* is electrically connected to the second metal line 5. The length of the current path of the upper short side 12*a* and the lower short side 12*b* is equal to the length of the current path of the right long side 13*a* and the left long side 13*b*.

The longitudinal current is equal to the transverse current in low frequency. The low frequency isolation 72 of the second curve 7 is near −10 dB or below −10 dB. The isolation for the low frequency of the two antennas is improved. The communication is better.

Figure 7:
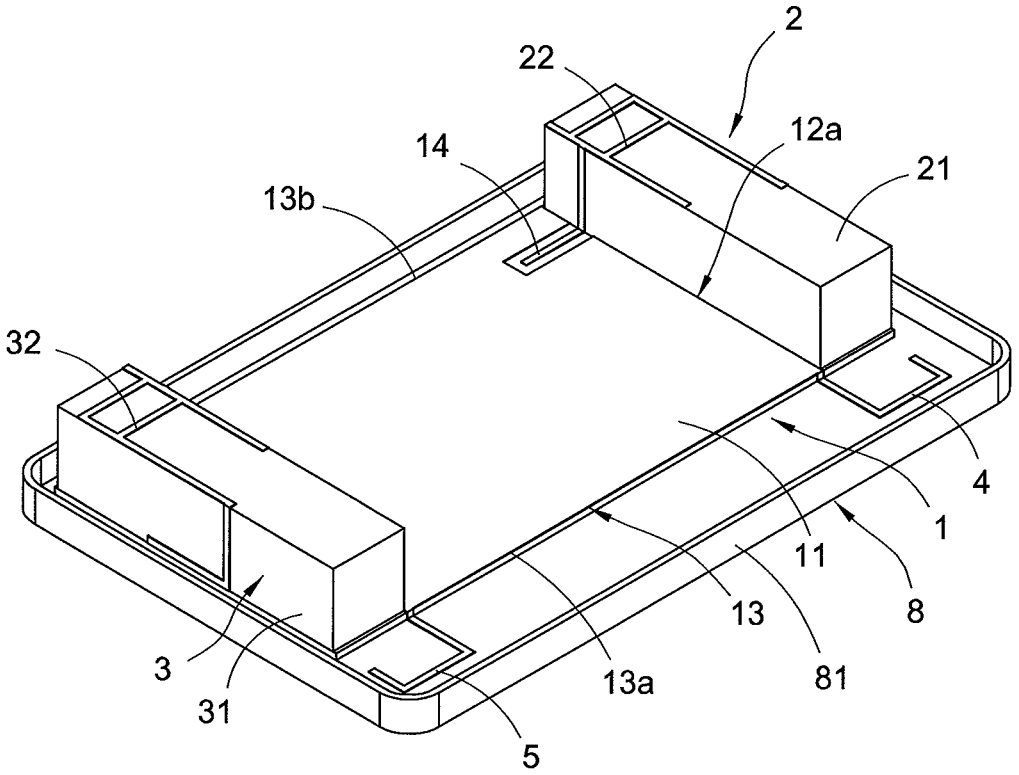
FIG. 7 shows another embodiment of the present invention.

FIG. 7 shows another embodiment of the present invention. The upper short side 12*a* is electrically connected to the first metal line 4. The lower short side 12*b* is electrically connected to the second metal line 5. The first metal line 4 either is reeled on the first rack 21 of the second antenna 2 or is pasted on a casing 81 of an electronic device 81. The second metal line 5 is either reeled on the second rack 31 of the second antenna 3 or is pasted on the casing 81 of the electronic device 81.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multi-antenna structure including:

a base plate having a grounded metal surface, the grounded metal surface having two short sides and two long sides;

a first antenna arranged on the base plate and arranged on one of the short sides;

a second antenna arranged on the base plate and arranged on the other short side;

a first metal line electrically connected to one of the short sides; and a second metal line electrically connected to the other short side, wherein a current path of the two short sides is prolonged because of the first metal line and the second metal line; a longitudinal current is equal to a transverse current at a low frequency; whereby a current of the first antenna and a current of the second antenna does not interfere each other; isolation between the first antenna and the second antenna is improved;

wherein the base plate is a printed circuit board; the base plate includes a first signal feed line and a second signal feed line; the two short sides of the base plate are an upper short side and a lower short side: the two long sides of the base plate are a right long side and a left long side;

wherein the first antenna includes a first rack; the first rack includes a first radiator having a plurality of metal lines; the first radiator is electrically connected to the first signal feed line; the first signal feed line is electrically connected to a coaxial cable;

wherein the second antenna includes a second rack; the sewn rack includes a second radiator having a plurality of metal lines; the second radiator is electrically connected to the second signal feed line; the second signal feed line is electrically connected to a coaxial cable;

wherein the first metal line is electrically connected to the upper short side of the grounded metal surface and is reeled on the first rack of the first antenna or is pasted on a casing of an electronic device;

wherein a length of the first metal line plus a length of the upper short side of the grounded metal surface is between one-half and one-eighth wavelength of a center frequency of the low frequency.

2. The multi-antenna structure in claim 1, wherein the length of the first metal line plus the length of the upper short side of the grounded metal surface is one-quarter wavelength of the center frequency of the low frequency.

3. The multi-antenna structure in claim 2, wherein the second metal line is electrically connected to the lower short side of the grounded metal surface and is reeled on the second rack of the second antenna or is pasted on the casing of the electronic device.

4. The multi-antenna structure in claim 3, wherein a length of the second metal line plus a length of the lower short side of the grounded metal surface is between one-half and one-eighth wavelength of the center frequency of the low frequency.

5. The multi-antenna structure in claim 4, wherein the length of the second metal line plus the length of the lower short side of the grounded metal surface is one-quarter wavelength of the center frequency of the low frequency.

* * * * *